US005926668A

United States Patent [19]

Lee

[11] Patent Number: 5,926,668

[45] Date of Patent: Jul. 20, 1999

[54] DEVELOPER SUPPLY METHOD OF WET ELECTROGRAPHIC PRINTER

[75] Inventor: Hyong-gu Lee, Puchun, Rep. of Korea

[73] Assignee: Samsung Electronics Co., Ltd., Kyungki-Do, Rep. of Korea

[21] Appl. No.: 09/124,643

[22] Filed: Jul. 30, 1998

[30] Foreign Application Priority Data

Dec. 12, 1997 [KR] Rep. of Korea ..... 97-68323

[51] Int. Cl.[6] ..... G03G 15/10

[52] U.S. Cl. ..... 399/57; 399/238; 399/247

[58] Field of Search ..... 399/57, 58, 59, 399/237, 238, 239, 246, 247, 248

[56] References Cited

U.S. PATENT DOCUMENTS 4,800,839 1/1989 Ariyama et al. ..... 399/57

*Primary Examiner*—Arthur T. Grimley
*Assistant Examiner*—Hoang Ngo
*Attorney, Agent, or Firm*—Sughrue, Mion, Zinn, Macpeak & Seas, PLLC

[57] ABSTRACT

A wet electrographic printer has (1) a reservoir for supplying a developer obtained by mixing a liquid carrier with an ink to a developing unit, (2) a carrier cartridge for supplying the liquid carrier to the reservoir, (3) an ink cartridge for supplying the ink to the reservoir, and (4) a process tank for receiving the processor from the reservoir. The developer supply method includes the steps of supplying the liquid carrier and the ink to the reservoir to fill the reservoir to a maximum level with developer having an optimum concentration, and determining whether the concentration and level of the developer in the reservoir is less than or equal to a minimum concentration and a minimum level, respectively. If the concentration of the developer is less than or equal to the minimum concentration and the level is higher than the minimum level, the developer is drained from the reservoir to the process tank until the level of the developer falls to the minimum level. Subsequently, liquid carrier and ink are supplied to the reservoir to fill the reservoir to the maximum level with developer having the optimum concentration. If, on the other hand, the concentration of the developer is higher than the minimum concentration and the level of the developer is less than or equal to the minimum level, liquid carrier and ink are supplied to the reservoir to fill the reservoir to the maximum level with developer having the optimum concentration.

5 Claims, 4 Drawing Sheets

DEVELOPER SUPPLY METHOD OF WET ELECTROGRAPHIC PRINTER

BACKGROUND OF THE INVENTION

1. Field of the Invention

The present invention relates to a wet electrographic printer, and more particularly, to a developer supply method of controlling the concentration and level of the developer in a wet electrographic printer.

2. Description of the Related Art

In general, a wet electrographic printer develops an electrostatic latent image formed on a photosensitive medium, such as a photosensitive belt, with a developer of a predetermined color, and transfers the developed image to a paper sheet. A developing unit applies developer to the photosensitive medium to develop the electrostatic latent image formed thereon, and a developer supply apparatus supplies developer of a predetermined density to the developing unit. The developer comprises a condensed ink containing a toner mixed with a liquid carrier. The developer includes the toner diluted to approximately 2–4 wt %. Hereinafter, the wt % of toner is referred to as the concentration of the developer.

The developer supply apparatus includes an ink cartridge for storing the condensed ink, a carrier cartridge for storing the liquid carrier, and a reservoir for storing the developer obtained by mixing the condensed ink with the liquid carrier at a predetermined ratio. Agitators, for preventing the toner from settling, may be installed in the ink cartridge and the reservoir.

Since developer stored in the reservoir is used to develop the electrostatic latent image formed on the photosensitive medium, the condensed ink and the liquid carrier must be supplied to the reservoir to maintain a predetermined developer concentration. Also, the developer stored in the reservoir must be replenished.

The consumption of toner and liquid carrier varies depending on the images printed. For example, more liquid carrier than toner is consumed to print a simple image or a small image; while more toner than liquid carrier is consumed to print a complicated image. Thus, in order to maintain the predetermined developer concentration, it is necessary to appropriately supply the toner and the liquid carrier to the reservoir in accordance with the consumption of the toner and the liquid carrier, respectively.

Conventional developer supply methods cannot control both the concentration and level of the developer stored in the reservoir. That is, if a lot of the liquid carrier is supplied to maintain the predetermined developer concentration, the level of the developer changes. Thus, undesired operating conditions may develop. On the other hand, if the level of the developer is controlled, the predetermined developer concentration can not be maintained.

SUMMARY OF THE INVENTION

An object of the present invention is to provide a developer supply method of a wet electrographic printer, capable of properly controlling the concentration and level of the developer.

Accordingly, a developer supply method of a wet electrographic printer having a reservoir for supplying a developer obtained by mixing a liquid carrier with an ink to a developing unit, a carrier cartridge for supplying the liquid carrier to the reservoir, an ink cartridge for supplying the ink to the reservoir, and a process tank for receiving the processor from the reservoir, includes the steps of: supplying the liquid carrier and the ink to fill the reservoir to a maximum level with developer having an optimum concentration; determining whether the concentration and level of the developer in the reservoir is less than or equal to a minimum concentration and a minimum level, respectively; if the concentration of the developer is less than or equal to the minimum concentration and the level of the developer in the reservoir is higher than the minimum level, (1) draining the developer of the reservoir to the process tank to lower the level of the developer in the reservoir to the minimum level, and (2) supplying the liquid carrier and the ink to the reservoir to fill the reservoir to the maximum level with developer having the optimum concentration; and if the concentration of the developer is higher than the minimum concentration and the level of the developer is less than or equal to the minimum level, supplying the liquid carrier and ink to the reservoir to fill the reservoir to the maximum level with developer having the optimum concentration.

Also, the method further includes the steps of determining whether the level of the developer in the process tank is higher than or equal to a predetermined recycle level, and supplying the predetermined recycle amount of the developer of the process tank to the reservoir, if the level of the developer in the process tank is higher than the recycle level in the determining step.

The above and other features of the invention including various and novel details of method steps will now be more particularly described with reference to the accompanying drawings and pointed out in the claims. It will be understood that the particular developer supply method embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENTS

Figure 1:
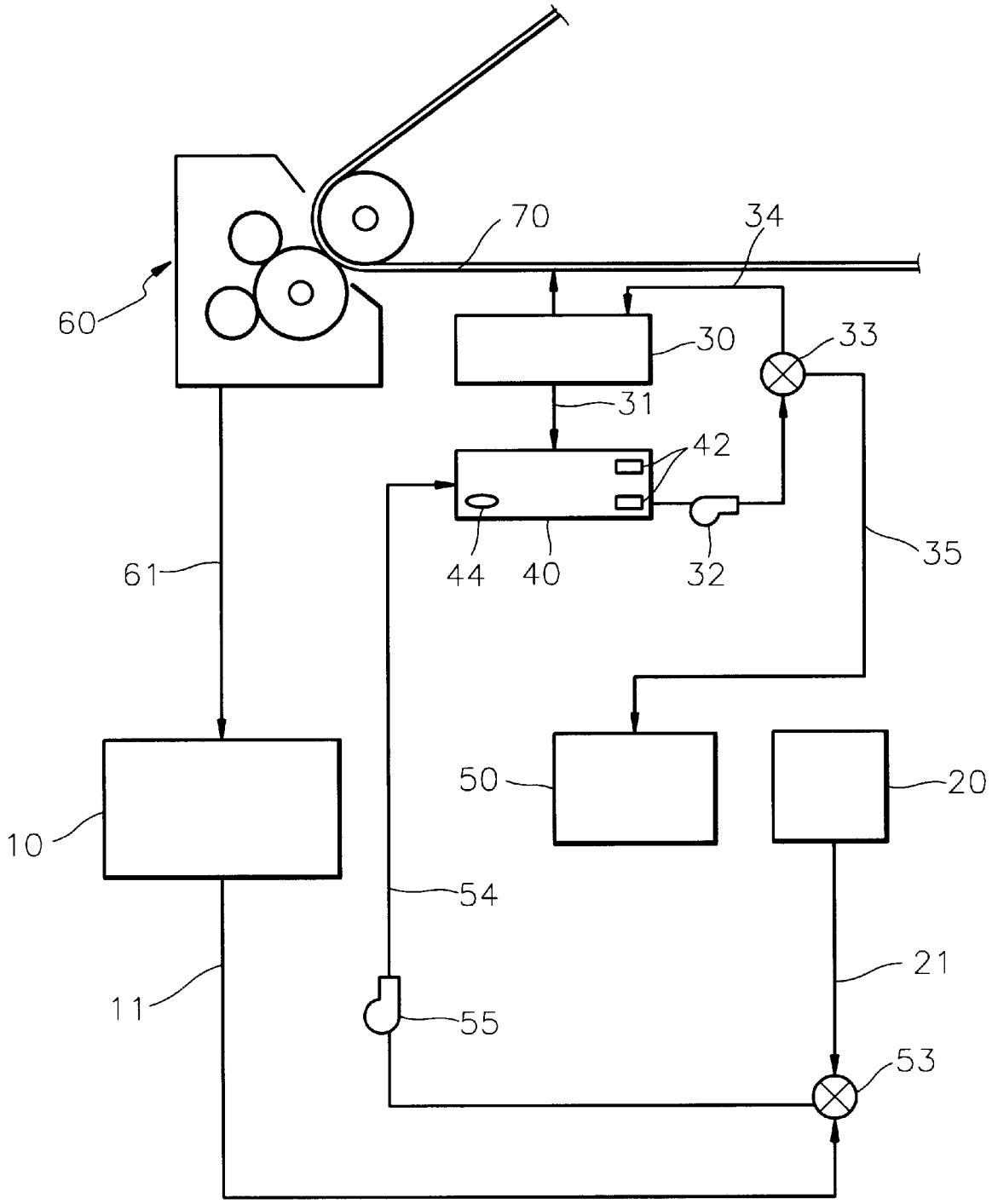
FIG. 1 is a schematic diagram of a developer supply apparatus of a wet electrographic printer employing a developer supply method according to an embodiment of the present invention.

Referring to FIG. 1, a wet electrographic printer according to an embodiment of the present invention includes a carrier cartridge 10 in which a liquid carrier is stored, and an ink cartridge 20 in which a condensed ink is stored. The carrier cartridge 10 and the ink cartridge 20 are replaceable.

The carrier cartridge 10 and the ink cartridge 20 are connected to a first valve 53, such as a solenoid two-way valve, through a carrier supply path 11 and an ink supply path 21, respectively. The first valve 53 selectively opens and closes the carrier supply path 11 and the ink supply path 21, so that ink and liquid carrier are supplied to a reservoir 40 through an ink/carrier supply path 54 by the driving force of a first pump 55.

A level sensor 42 for sensing the level of the developer in the reservoir 40, and a concentration sensor 44 for sensing the concentration thereof, are installed in the reservoir 40. The reservoir 40 supplies the developer to a developing unit 30 through a developer supply path 34 by the driving force of a second pump 32. The developing unit 30 develops an electrostatic latent image formed on a photosensitive belt 70 using the developer supplied from the reservoir 40.

A second valve 33, such as a solenoid two-way valve, is installed in the developer supply path 34. The second valve 33 selectively blocks the developer supply path 34 and a developer drain path 35, to direct the developer to the developer unit 30 and a process tank 50 through the developer supply path 34 and the developer drain path 35, respectively.

A drying unit 60 recovers liquid carrier adhering to the photosensitive belt 70. The recovered liquid carrier returns to the carrier cartridge 10 along a collection pipe 61.

Figure 2:
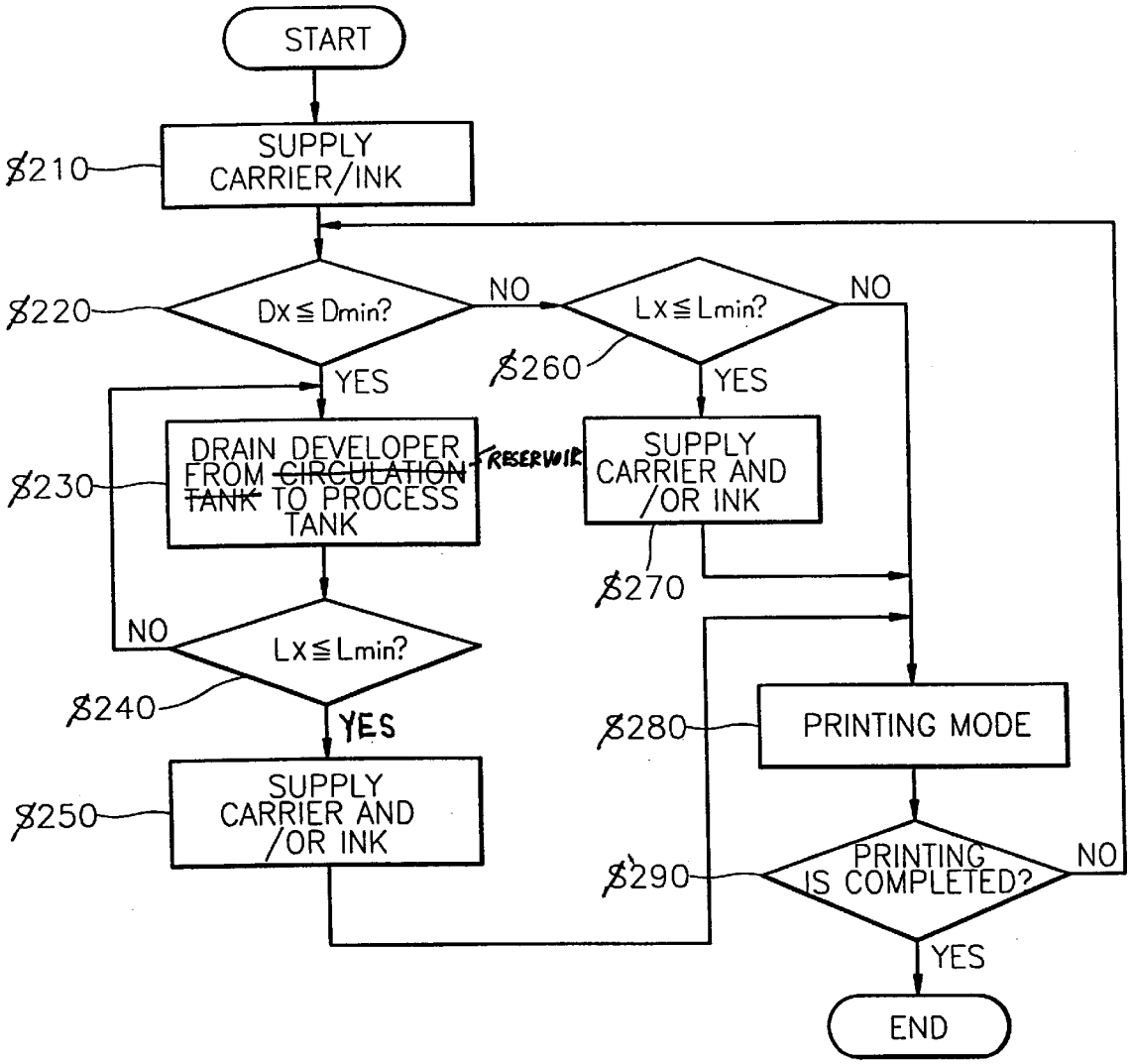
FIG. 2 is a flowchart of a developer supply method according to an embodiment of the present invention.

The developer supply method of an apparatus having the above structure will be described with reference to FIGS. 1 and 2.

When the power of a printer is turned on, the liquid carrier and ink are supplied to the reservoir 40 (step 210). That is, the first valve 53 selectively opens the ink supply path 21 and the carrier supply path 11 to supply ink and liquid carrier from the ink cartridge 20 and the carrier cartridge 10 to the reservoir 40 through the ink/carrier supply path 54. Initially, the ink and liquid carrier are supplied in amounts to provide a developer having an optimum concentration $D_{opt}$ between a minimum concentration $D_{min}$ and a maximum concentration $D_{max}$. Also, the level of the developer in the reservoir 40 is at a maximum level $L_{max}$. The concentration and level of the developer are properly controlled according to printing conditions.

The developer in the reservoir 40 is supplied to the developing unit 30 along the developer supply path 34 by the driving force of the second pump 32. At this time, the developer drain path 35 is closed by the second valve 33. Thus, the electrostatic latent image formed on the photosensitive belt 70 is developed using the supplied developer. Collection means, such as a squeegee roller (not shown), removes excess developer from the photosensitive belt 70. The excess developer collects in the reservoir 40 through the path 31. When the amount of consumed ink is different from that of carrier, the concentration of the developer collected through the path 31 differs from that of the developer supplied through the developer supply path 34, thereby changing the concentration of the developer stored in the reservoir 40.

At step 220, the concentration sensor 44 measures the concentration of the developer, and transmits the measured concentration to a controller (not shown) to determine whether the concentration $D_x$ of the developer in the reservoir 40 is at a minimum concentration $D_{min}$. The minimum concentration $D_{min}$ is set to a value at which print quality starts to deteriorate unacceptably.

If the concentration $D_x$ of the developer is less than the minimum concentration $D_{min}$, the developer in the reservoir 40 is drained to the process tank 50 until the level $L_x$ of the developer drops to a minimum level $L_{min}$. That is, the controller stops the printing, and operates the second valve 33 to block the developer supply path 34 and open the developer drain path 35. Thus, the developer in the reservoir is drained to the process tank 50 by the second pump 32 (step 230). This ensures sufficient room in the reservoir 40 into which to supply new ink and liquid carrier.

At step 240, the level sensor 42 installed in the reservoir 40 determines whether the level $L_x$ of the developer is less than the minimum level $L_{min}$. The minimum level $L_{min}$ is determined based on the capacity of the reservoir 40. If the level of the developer is higher than the minimum level $L_{min}$, the sequence returns to step 230. If the level $L_x$ of the developer is less than the minimum level $L_{min}$, the first valve 53 operates to supply liquid carrier and/or ink to the reservoir 40 (step 250). The amounts of supplied liquid carrier and ink are controlled such that the developer fills the reservoir 40 to the maximum level $L_{max}$ and has the optimum concentration $D_{opt}$. The sequence proceeds to step 280.

On the other hand, if the concentration $D_x$ of the developer is higher than the minimum concentration $D_{min}$ at step 220, it is determined whether the level $L_x$ of the developer in the reservoir 40 is less than the minimum level $L_{min}$ (step 260). If so, the liquid carrier and/or ink is supplied to the reservoir 40 such that the developer fills the reservoir 40 to the maximum level $L_{max}$ and has the optimum concentration $D_{opt}$ (step 270). If not, the sequence proceeds to step 280.

In all cases, printing is performed under conditions in which the concentration and level of the developer in the reservoir 40 are normal (step 280).

It is determined whether the printing is finished or not (step 290). If the printing is not finished, the sequence returns to step 220.

According to the present invention, if the concentration and level of the developer are inappropriate, the developer in the reservoir 40 is partially drained to the process tank 50, to thereby ensure sufficient room for supplying new ink and liquid carrier. Thus, the concentration and level of the developer can be relatively easily controlled.

Figure 3:
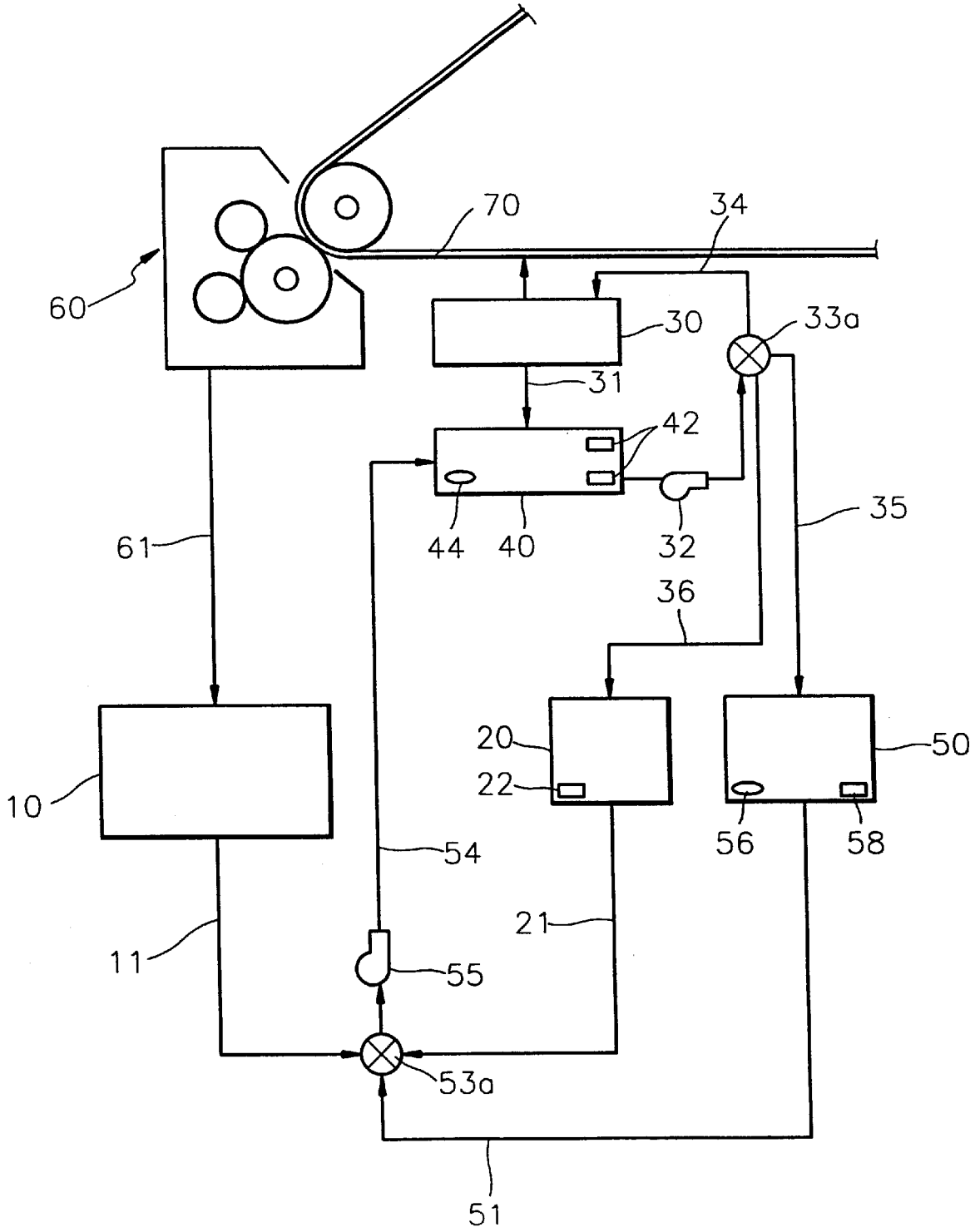
FIG. 3 is a schematic diagram of a developer supply apparatus of a wet electrographic printer employing a developer supply method according to another embodiment of the present invention.

The structure of the developer supplying apparatus employing the developer supply method according to another embodiment of the present invention is shown in FIG. 3. The same reference numerals represent the same elements having the same functions as those shown in FIG. 1.

In this embodiment, the process tank 50 is connected to a third valve 53*a*, such as a solenoid three-way valve, by a recycle path 51. Thus, the developer in the process tank 50 is supplied to the reservoir 40 by the recycle path 51 and the third valve 53*a*. In this way, the developer in the process tank 50 is reusable.

The developer supply method will be described with reference to FIGS. 3 and 4. Steps 210 through 290 are the same as the above-described embodiment.

If the level $L_x$ measured at step 260 is less than the minimum level $L_{min}$, a level sensor 58 determines whether the level $L_{px}$ of the developer in the process tank 50 is less than a predetermined recycle level $L_r$ (step 410).

If the level $L_{px}$ of the developer in the process tank 50 is less than the recycle level $L_r$, the developer stored in the process tank 50 is insufficient to refill the reservoir 40. Thus, carrier and/or ink is supplied from the carrier cartridge 10 and the ink cartridge 20 to the reservoir 40 (step 270).

If the level $L_{px}$ of the developer in the process tank 50 is higher than the recycle level $L_r$ at step 410, a concentration sensor 56 measures the concentration $D_{px}$ of the developer in the process tank 50 (step 420). Subsequently, the developer of the process tank 50 is supplied to the reservoir 40 together with liquid carrier and/or ink until the level $L_x$ of the developer in the reservoir 40 reaches the maximum level $L_{max}$. At this time, the supply ratio of the liquid carrier and ink is properly controlled according to the concentration $D_{p,x}$ of the developer in the process tank, so that the developer in the reservoir 40 has the optimum concentration $D_{opt}$.

Finally, the printing is performed in the same manner described in step 280.

The method according to the present invention will become more apparent by way of the following examples. The developer in the examples, is a solution obtained by mixing approximately 133 ml of ink containing 9 wt % of toner with approximately 267 ml of liquid carrier. Thus, the developer concentration is approximately 3 wt % (optimum concentration). Also, the maximum level $L_{max}$ of the reservoir 40 is approximately 400 ml, and the minimum level $L_{min}$ thereof is 340 ml. The term coverage is defined as the ratio of the area of a printed image to that of a sheet of A4 paper.

Example 1

If the coverage is 5% and 670 sheets of paper are printed, the concentration of the developer in the reservoir 40 becomes 2 wt %, which is a minimum concentration $D_{min}$ (step 220 of FIG. 2), and the level of the developer becomes approximately 345 ml. Then, the controller temporarily stops the printing upon receiving a signal transmitted from the concentration sensor 44.

Here, 5 ml of the developer in the reservoir 40 is drained to the process tank 50 (step 230), so that the level of the reservoir 40 becomes a minimum level $L_{min}$ of 340 ml (step 240). Then, 60 ml of the ink in the ink cartridge 20 is supplied to the reservoir 40 (step 250). Thus, the concentration and level of the final developer in the reservoir 40 become 3 wt % and 400 ml, respectively. Subsequently, printing is resumed.

Example 2

If the coverage is 100% and 27 sheets of paper are printed, the concentration and level of developer in the reservoir 40 becomes 2 wt % (the minimum concentration) and 390 ml, respectively. As described above, the printing is stopped (step 220 of FIG. 2), and then 50 ml of the developer is drained from the reservoir 40 to the process tank 50 (steps 230 and 240).

Subsequently, if 60 ml of the ink in the ink cartridge 20 is supplied to the reservoir 40 (step 250), the concentration and level of the developer in the reservoir 40 become 3 wt % and 400 ml, respectively.

Example 3

If the coverage is 0%, i.e., very little toner is consumed, and 763 sheets of paper are printed, the concentration and level of the developer in the reservoir 40 become 3.5 wt % and 340 ml, which is the minimum level $L_{min}$. Thus, the level $L_x$ of the developer in the reservoir 40 measured by the level sensor 42 becomes the minimum level $L_{min}$, so that the operation of the printer is stopped by the controller (step 260 of FIG. 1).

At this time, 60 ml of liquid carrier is supplied to the reservoir 40, so that the concentration and level of the developer return to 3 wt % and 400 ml.

Example 4

Figure 4:
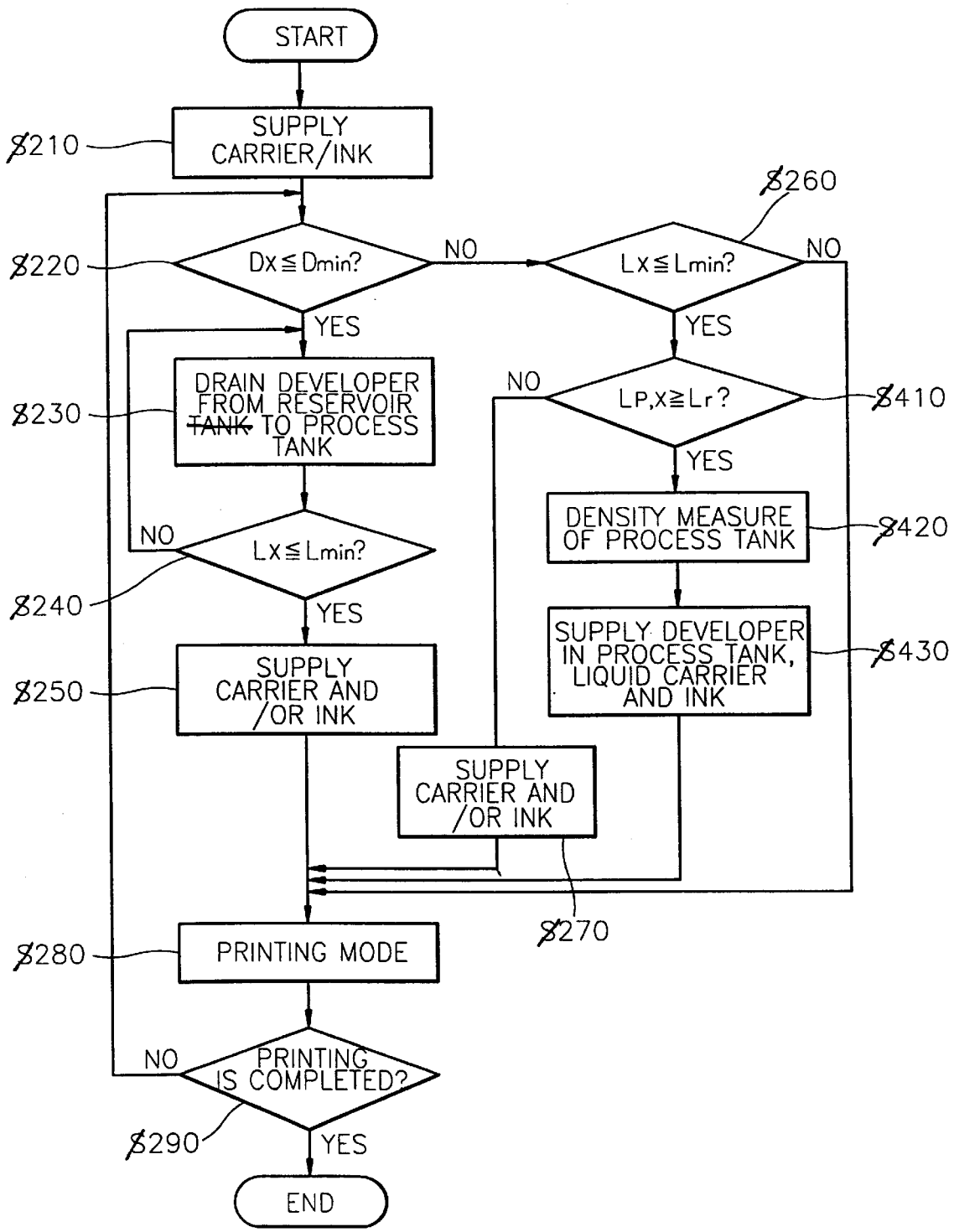
FIG. 4 is a flowchart of a developer supply method according to another embodiment of the present invention.

If the coverage is 3% and 740 sheets of paper are printed, the concentration and level of the developer in the reservoir 40 become 2.45 wt % and 340 ml, which is a minimum level, so that the printing is temporarily stopped (step 260 of FIG. 4). Assuming that the process tank 50 contains more than the recycle level $L_r$, i.e., 30 ml, of developer having concentration of 2 wt % concentration, (steps 410 and 420, respectively).

In the above case, 60 ml of developer having a concentration of 6.1 wt % is required to obtain 400 ml of developer having a concentration of 3 wt %. Thus, 35.1 ml of the ink in the ink cartridge 20 and 24.9 ml of the developer in the process tank 50 are supplied to the reservoir 40 (step 430).

If the developer in the process tank 50 is less than the recycle level $L_r$, i.e., 30 ml at step 410, 40.7 ml of the ink in the ink cartridge and 19.3 ml of the liquid carrier in the carrier cartridge 10 are supplied to the reservoir 40 (step 270).

According to the present invention, an additional process tank is provided, into which the developer in the reservoir is drained, to thereby easily control the concentration and level of the developer. Also, the developer in the process tank can be reused while maintaining the correct developer concentration.

In the specification, the developer supply method for one developing unit is disclosed. However, the above developer supply method may also be employed in an electrographic color printer having a plurality of developing units corresponding to colors of, for example, yellow, magenta, cyan and black.

What is claimed is:

1. A developer supply method of a wet electrographic printer of the type having (1) a reservoir for supplying a developer, which includes a liquid carrier mixed with an ink, to a developing unit, (2) a carrier cartridge for supplying the liquid carrier to the reservoir, (3) an ink cartridge for supplying the ink to the reservoir, and (4) a process tank for receiving the developer from the reservoir, said method comprising the steps of:

(a) supplying the liquid carrier and the ink to the reservoir to fill the reservoir to a maximum level with developer having an optimum concentration;

(b) determining whether the concentration of the developer in the reservoir is less than or equal to a minimum concentration, and whether the level of the developer in the reservoir is less than or equal to a minimum level;

(c) if the concentration of the developer is less than or equal to the minimum concentration and the level of the developer in the reservoir is higher than the minimum level, in step (b):

(i) draining the developer from the reservoir to the process tank until the level of the developer in the reservoir is less than or equal to the minimum level; and (ii) supplying the liquid carrier and the ink to the reservoir to fill the reservoir to a maximum level with developer having an optimum concentration; and (d) if the concentration of the developer is higher than the minimum concentration and the level of the developer in the reservoir is less than or equal to the minimum level, in step (b):

(i) supplying the liquid carrier and the ink to the reservoir to fill the reservoir to a maximum level with developer having an optimum concentration.

2. The method of claim 1, wherein step (d) comprises the steps of:

determining whether the level of the developer in the process tank is higher than or equal to a predetermined recycle level;

(i) if so, supplying developer from the process tank to the reservoir, and supplying the liquid carrier and the ink to the reservoir to fill the reservoir to a maximum level with developer having an optimum concentration; and (ii) if not, supplying the liquid carrier and the ink to the reservoir to fill the reservoir to a maximum level with developer having an optimum concentration.

3. The method of claim 1, wherein the optimum concentration and the minimum concentration of the developer is 3 wt % and 2 wt %, respectively.

4. The method of claim 1, wherein the reservoir holds about 400 ml of developer when filled to the maximum level, and about 360 ml of developer when filled to the minimum level.

5. The method of claim 2, wherein the process tank hold about 30 ml of developer when filled to the predetermined recycled level.

* * * * *